US011426735B2

(12) United States Patent
Liang et al.

(10) Patent No.: US 11,426,735 B2
(45) **Date of Patent: *Aug. 30, 2022**

(54) NUCLEIC ACID ANALYSIS APPARATUS

(71) Applicant: Delta Electronics Int'l (Singapore) Pte Ltd, Singapore (SG)

(72) Inventors: Qian Liang, Singapore (SG); Hao Yu, Singapore (SG); Haoyu Wei, Singapore (SG)

(73) Assignee: DELTA ELECTRONICS INT'L (SINGAPORE) PTE LTD, Singapore (SG)

( * ) Notice: Subject to any disclaimer, the term of this patent is extended or adjusted under 35 U.S.C. 154(b) by 839 days.

This patent is subject to a terminal disclaimer.

(21) Appl. No.: 16/262,539

(22) Filed: Jan. 30, 2019

(65) Prior Publication Data

US 2019/0160468 A1 May 30, 2019

Related U.S. Application Data

(63) Continuation-in-part of application No. 15/938,082, filed on Mar. 28, 2018, now Pat. No. 10,850,281, (Continued)

(30) Foreign Application Priority Data

Feb. 8, 2018 (SG) ..... 10201801085V
Sep. 28, 2018 (SG) ..... 10201808600T

(51) Int. Cl.
*B01L 3/00* (2006.01)
*B01L 7/04* (2010.01)
*B01L 7/00* (2006.01)

(52) U.S. Cl.
CPC ..... *B01L 3/527* (2013.01); *B01L 3/502715* (2013.01); *B01L 7/04* (2013.01); (Continued)

(58) Field of Classification Search
CPC ..... B01L 3/502715; B01L 3/527; B01L 7/04; B01L 7/525; B01L 2300/08; (Continued)

(56) References Cited

U.S. PATENT DOCUMENTS 8,441,629 B2 5/2013 Kolesnychenko et al.
2004/0053290 A1 3/2004 Terbrueggen et al.
(Continued)

FOREIGN PATENT DOCUMENTS

CN 101675170 A 3/2010
CN 101748212 A 6/2010
(Continued)

*Primary Examiner* — Gautam Prakash
(74) *Attorney, Agent, or Firm* — Kirton McConkie; Evan R. Witt

(57) ABSTRACT

A nucleic acid analysis apparatus includes a casing, a main frame, a fluid delivery unit, a thermal unit, a driving unit, and at least one optical unit. The casing has an upper casing and a lower casing. The main frame is disposed in the lower casing and has a chamber for mounting a cartridge therein. The fluid delivery unit is adapted to transport reagents within the cartridge for sample purification and/or nucleic acid extraction. The thermal unit is adapted to provide a predefined temperature for nucleic acid amplification. The driving unit is disposed in the lower casing and connected with the main frame, and includes a motion control unit capable of pressing the cartridge during sample purification and/or nucleic acid extraction and rotating the cartridge with a predefined program during nucleic acid amplification and/or detection. The optical unit includes plural optical components for detection.

18 Claims, 12 Drawing Sheets

Related U.S. Application Data which is a continuation-in-part of application No. 15/700,791, filed on Sep. 11, 2017, now Pat. No. 10,654,038.

(60) Provisional application No. 62/393,211, filed on Sep. 12, 2016, provisional application No. 62/393,223, filed on Sep. 12, 2016.

(52) U.S. Cl.
CPC ..... *B01L 7/525* (2013.01); *B01L 2200/025* (2013.01); *B01L 2200/027* (2013.01); *B01L 2200/14* (2013.01); *B01L 2200/16* (2013.01); *B01L 2300/0654* (2013.01); *B01L 2300/0663* (2013.01); *B01L 2300/08* (2013.01); *B01L 2300/1805* (2013.01); *B01L 2300/1883* (2013.01)

(58) Field of Classification Search
CPC ..... B01L 2200/02; B01L 2200/07; B01L 2200/025; B01L 2300/0654; B01L 2200/14; B01L 2200/16; B01L 2300/0663; B01L 2300/1883; B01L 2300/1805
See application file for complete search history.

(56) References Cited

U.S. PATENT DOCUMENTS

| | | | | |
|---|---|---|---|---|
| 2005/0233324 | A1 | 10/2005 | Corbett et al. | |
| 2006/0040303 | A1 | 2/2006 | Weilke | |
| 2006/0204997 | A1 | 9/2006 | Macioszek et al. | |
| 2006/0223061 | A1 | 10/2006 | Corbett et al. | |
| 2007/0154922 | A1 | 7/2007 | Collier et al. | |
| 2008/0153078 | A1 | 6/2008 | Braman et al. | |
| 2010/0086990 | A1 | 4/2010 | Stanley et al. | |
| 2011/0044865 | A1 | 2/2011 | Groisman et al. | |
| 2014/0004621 | A1 | 1/2014 | Cepheid | |
| 2015/0135502 | A1 | 5/2015 | Rankin et al. | |
| 2015/0136604 | A1* | 5/2015 | Nielsen et al. | B01L 7/52 204/453 |

FOREIGN PATENT DOCUMENTS

| | | | |
|---|---|---|---|
| CN | 201884767 | U | 6/2011 |
| CN | 102341710 | A | 2/2012 |
| CN | 102422143 | A | 4/2012 |
| CN | 103424304 | A | 12/2013 |
| CN | 104204229 | A | 12/2014 |
| CN | 104630373 | A | 5/2015 |
| CN | 204625604 | U | 9/2015 |
| CN | 105316224 | A | 2/2016 |
| CN | 105940094 | A | 9/2016 |
| CN | 106222069 | A | 12/2016 |
| EP | 1180135 | B1 | 8/2005 |
| TW | M445583 | U | 1/2013 |
| TW | 201333188 | A | 8/2013 |
| TW | 201617454 | A | 5/2016 |
| WO | 98/49340 | A1 | 11/1998 |
| WO | 2015057574 | A1 | 4/2015 |

* cited by examiner

NUCLEIC ACID ANALYSIS APPARATUS

CROSS-REFERENCE TO RELATED APPLICATION

This application is a continuation-in-part of U.S. patent application Ser. No. 15/938,082 filed on Mar. 28, 2018, now U.S. Pat. No. 10,850,281 issued Dec. 1, 2020, which claims the priority to Singapore Patent Application No. 10201801085V filed on Feb. 8, 2018 and is a continuation-in-part of U.S. patent application Ser. No. 15/700,791 filed on Sep. 11, 2017, now U.S. Pat. No. 10,654,038 issued May 19, 2020, which claims the benefit of U.S. Provisional Application Ser. No. 62/393,211 filed on Sep. 12, 2016 and the benefit of U.S. Provisional Application Ser. No. 62/393,223 filed on Sep. 12, 2016, the entirety of which is hereby incorporated by reference. This application also claims the priority to Singapore Patent Application No. 10201808600T filed on Sep. 28, 2018, the entirety of which is hereby incorporated by reference.

The present invention relates to a nucleic acid analysis apparatus, and more particularly to an all-in-one nucleic acid analysis apparatus.

BACKGROUND OF THE INVENTION

Point-of-care (POC) testing is an analytical method conducted outside the central hospital and/or laboratory using devices that can instantly interpret the results. With the increasing threat of accelerated epidemic-to-pandemic transitions of new or reemerging infectious disease outbreaks owing to globalization, decentralizing diagnostic testing at frontline clinical settings could facilitate earlier implementations of public health responses to contain and mitigate such events. In the developing countries where high infectious disease burden is compounded by diagnostic challenges due to poor clinical laboratory infrastructure and cost constraints, the potential utility for POC testing is even greater.

Recently, some POC devices are developed for molecular diagnostics with isothermal based nucleic acid amplification. The associated disposable cartridge is mounted into the device for fluid processing and subsequently is able to be lifted and freely rotated for amplification and multiple channel optical detection. In such design, the cartridge is placed in the bottom chamber of the device, and the driving unit is mounted in the top chamber. Since the driving unit utilizes a stepper motor with high holding torque to realize the predefined motion of the cartridge, the overall cost, size, weight and power input of the device are increased. Further, as the driving unit is mounted in the top chamber, the device has almost equal sized top and bottom parts. As a result, the heavy top part may introduce potential risk of device turning over during the operation, and the users have to carefully hold the top part during the cartridge mounting and this is not acceptable in the reality.

Therefore, there is a need of providing an improved POC device to overcome the drawbacks of the prior arts.

SUMMARY OF THE INVENTION

An object of the embodiment of the present invention is to provide an all-in-one nucleic acid analysis apparatus, so that the processes of sample purification, nucleic acid extraction, nucleic acid amplification and nucleic acid detection may be performed on the all-in-one apparatus to realize nucleic acid analysis in real time.

Another object of the embodiment of the present invention is to provide a nucleic acid analysis apparatus capable of simultaneously detecting multiple targets.

An additional object of the embodiment of the present invention is to provide a nucleic acid analysis apparatus with simplified structural design, improved heating efficiency and smooth fluid processing.

According to an aspect of the embodiment of the present invention, there is provided a nucleic acid analysis apparatus including a casing, a main frame, a fluid delivery unit, a thermal unit, a driving unit, and at least one optical unit. The casing has an upper casing and a lower casing. The main frame is disposed in the lower casing and has a chamber for mounting a cartridge therein. The fluid delivery unit is disposed in the lower casing and connected with the main frame, and is adapted to transport reagents within the cartridge for sample purification and/or nucleic acid extraction. The thermal unit is disposed on the main frame of the lower casing and adapted to provide a predefined temperature for nucleic acid amplification. The driving unit is disposed in the lower casing and connected with the main frame, and includes a motion control unit capable of pressing the cartridge toward the fluid delivery unit during sample purification and/or nucleic acid extraction and rotating the cartridge with a predefined program during nucleic acid amplification and/or detection. The at least one optical unit is disposed on the main frame of the lower casing and includes plural optical components for detection.

In an embodiment, the driving unit further comprises a stepper motor, which actuates a rotation of the motion control unit through gear transmission.

In an embodiment, the motion control unit comprises at least one protrusion, the cartridge comprises at least one guiding groove, and the protrusion is able to slide in the guiding groove.

In an embodiment, the guiding groove comprises a vertical groove and an inclined groove.

In an embodiment, the nucleic acid analysis apparatus further comprises a fluid connector located between the main frame and the fluid delivery unit, and a spring-supported component equipped on the fluid connector.

In an embodiment, a forward rotation of the motion control unit allows the cartridge to be locked and in tight contact with the fluid connector.

In an embodiment, a reverse rotation of the motion control unit allows the cartridge to be bounced up by the spring-supported component, detach the fluid connector, and rotate according to the predefined program.

In an embodiment, the motion control unit comprises a plurality of rollers, which are accommodated in an annular groove of the main frame.

In an embodiment, the nucleic acid analysis apparatus further comprises a sensor to recognize a position of the cartridge.

In an embodiment, the nucleic acid analysis apparatus further comprises an indicator, which is shining when the cartridge is pressed to the end to inform a user to release his hand.

In an embodiment, the cartridge comprises a reaction chip and a cartridge body, and the reaction chip is disposed on one side of the cartridge body.

In an embodiment, the reaction chip is a planar fluidic chip and comprises plural detection wells and at least one microchannel connected with the detection wells.

In an embodiment, the shape of the reaction chip is substantially a regular polygon, and each of the detection wells has at least one planar surface.

In an embodiment, the main frame further comprises at least one positioning component, and the reaction chip comprises at least one alignment slot capable of being aligned with the at least one positioning component on the main frame.

In an embodiment, the cartridge body comprises plural chambers used to store reagents for sample purification and nucleic acid extraction.

In an embodiment, the reaction chip further comprises at least one sample loading hole at a top surface of the reaction chip for adding sample into the cartridge.

In an embodiment, the thermal unit carries the reaction chip thereon to provide heating.

In an embodiment, the optical unit comprises a light source and an optical detector.

In an embodiment, the nucleic acid analysis apparatus comprises multiple optical units, and each optical unit offers a unique wavelength of illumination to detect multiple targets.

In an embodiment, the nucleic acid analysis apparatus further comprises a touch screen disposed on the lower casing with adjustable operation angles.

The above objects and advantages of the embodiments of the present invention become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of the embodiments of this invention are presented herein for purpose of illustration and description only; it is not intended to be exhaustive or to be limited to the precise form disclosed.

The present invention provides an all-in-one nucleic acid analysis apparatus, which integrates a fluid delivery unit, a thermal unit, a driving unit, and at least one optical unit on one single device, so that the processes of sample purification, nucleic acid extraction, nucleic acid amplification and nucleic acid detection can be performed on the all-in-one apparatus to realize nucleic acid analysis in real time.

Figure 1:
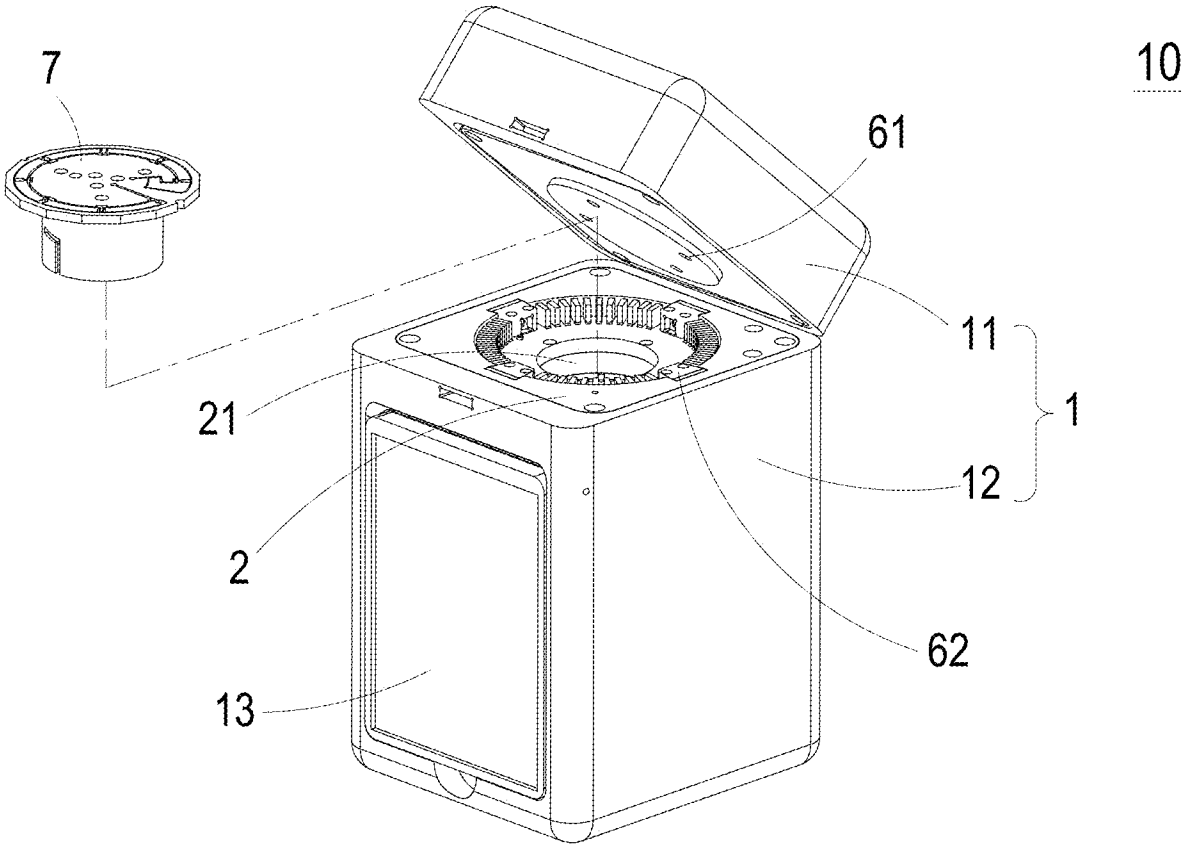
FIGS. 1 and 2 show schematic views of the nucleic acid analysis apparatus according to the embodiment of the present invention.
Figure 2:
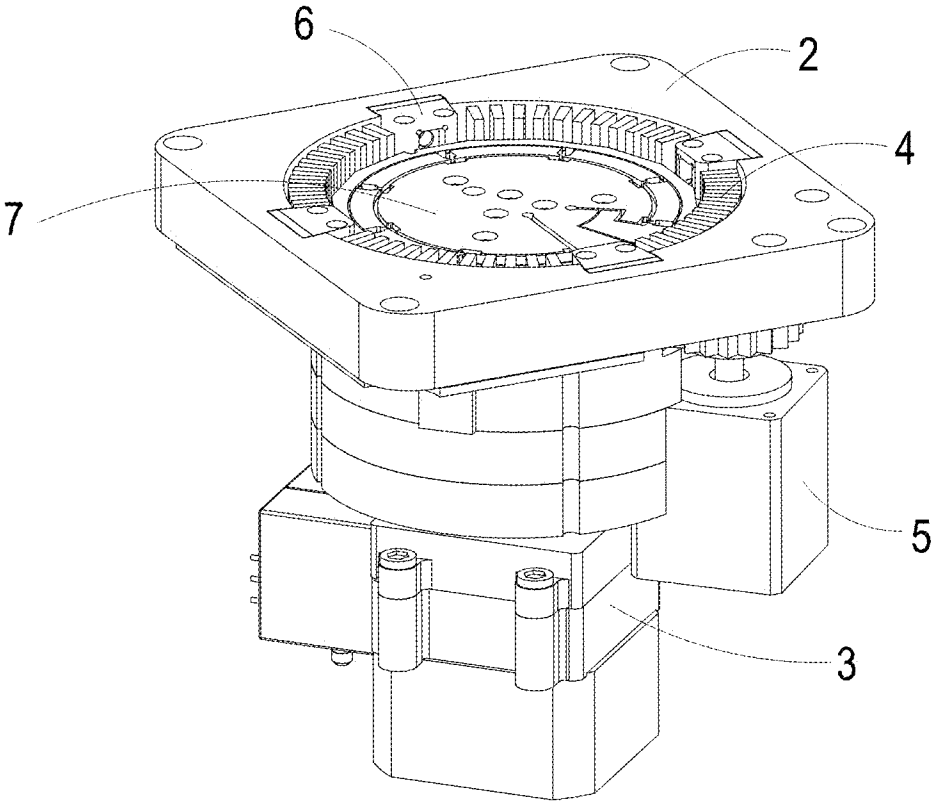

FIGS. 1 and 2 show schematic views of the nucleic acid analysis apparatus according to the embodiment of the present invention, wherein the nucleic acid analysis apparatus in FIG. 1 is opened and the cartridge is moved out of the nucleic acid analysis apparatus, and the outer casing of the nucleic acid analysis apparatus is removed and the rest components such as wires, tubing connection and PCB are not illustrated in FIG. 2 for a better viewing purpose. As shown in FIGS. 1 and 2, the nucleic acid analysis apparatus 10 includes a casing 1, a main frame 2, a fluid delivery unit 3, a thermal unit 4, a driving unit 5, and at least one optical unit 6, wherein the casing 1 includes an upper casing 11 and a lower casing 12, and the main frame 2, the fluid delivery unit 3, the thermal unit 4, the driving unit 5, and the at least one optical unit 6 are all disposed in the lower casing 12. The main frame 2 has a chamber 21 specifically designed for mounting a cartridge 7 therein. The fluid delivery unit 3 is connected with the main frame 2 and adapted to transport reagents within the cartridge 7 for sample purification and/or nucleic acid extraction. The thermal unit 4 is disposed on the main frame 2 and adapted to provide a predefined temperature for nucleic acid amplification. The driving unit 5 is connected with the main frame 2 and includes a motion control unit 52, which is capable of pressing the cartridge 7 toward the fluid delivery unit 3 during sample purification and/or nucleic acid extraction and rotating the cartridge 7 with a predefined program during nucleic acid amplification and/or detection. The at least one optical unit 6 is disposed on the main frame 2 and includes plural optical components for detection, such as nucleic acid detection or sample reaction detection.

In an embodiment, the nucleic acid analysis apparatus 10 further includes a controller, such as micro control unit (MCU), which controls the operations of the fluid delivery unit 3, the thermal unit 4, the driving unit 5 and the optical unit 6.

In an embodiment, the upper casing 11 and the lower casing 12 are connected through a hinge, but not limited thereto. The upper casing 11 can be opened, so that the cartridge 7 is able to be placed into the chamber 21 of the main frame 2. When the upper casing 11 is closed, a confined space is formed in the casing 1.

Figure 3:
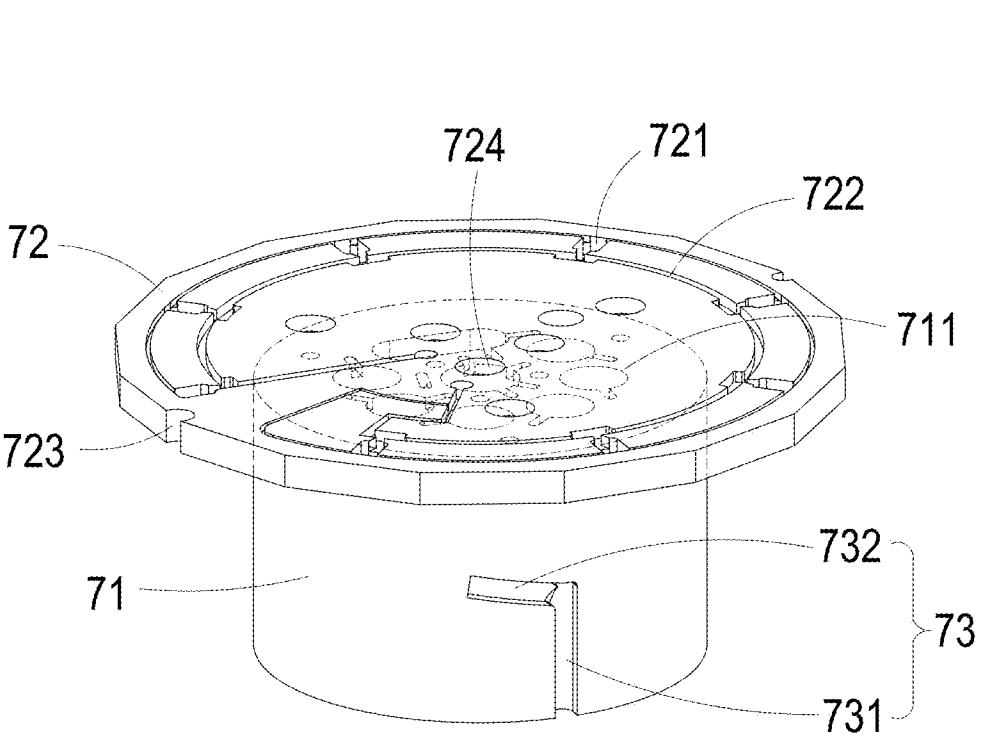
FIGS. 3 and 4 show different views of the cartridge.
Figure 4:
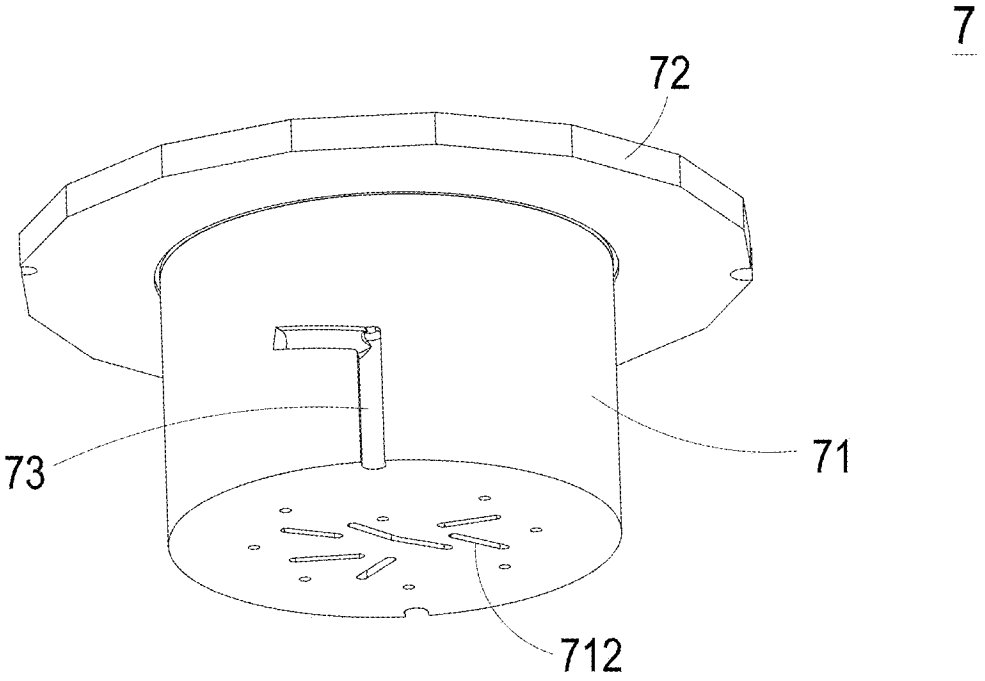

FIGS. 3 and 4 show different views of the cartridge. As shown in FIGS. 3 and 4, the cartridge 7 includes a cartridge body 71 and a reaction chip 72, and the reaction chip 72 is disposed on one side of the cartridge body 71, such as the top of the cartridge body 71. The reaction chip 72 is a planar fluidic chip, and includes plural detection wells 721 and at least one microchannel 722 connected with the detection wells 721. In an embodiment, the detection wells 721 include reagents for nucleic acid amplification and/or detection. For example, the detection wells 721 may be coated with reagents for nucleic acid amplification and/or detection, such as reagents containing different fluorescent dyes.

The number of the detection wells 721 is not limited, and may be up to 40 or even more, and the apparatus could perform multiplexing nucleic acid analysis. In an embodiment, the shape of the reaction chip 72 is substantially a regular polygon, so that the reaction chip 72 has plural planar side surfaces to be in line with the optical unit 6 to facilitate light focusing. Certainly, the shape of the reaction chip 72 is not limited to the regular polygon and it may also be circular or other shape, since the light could be focused on the sample in the detection well 721 by the arrangement of optical components of the optical unit 6.

Figure 5:
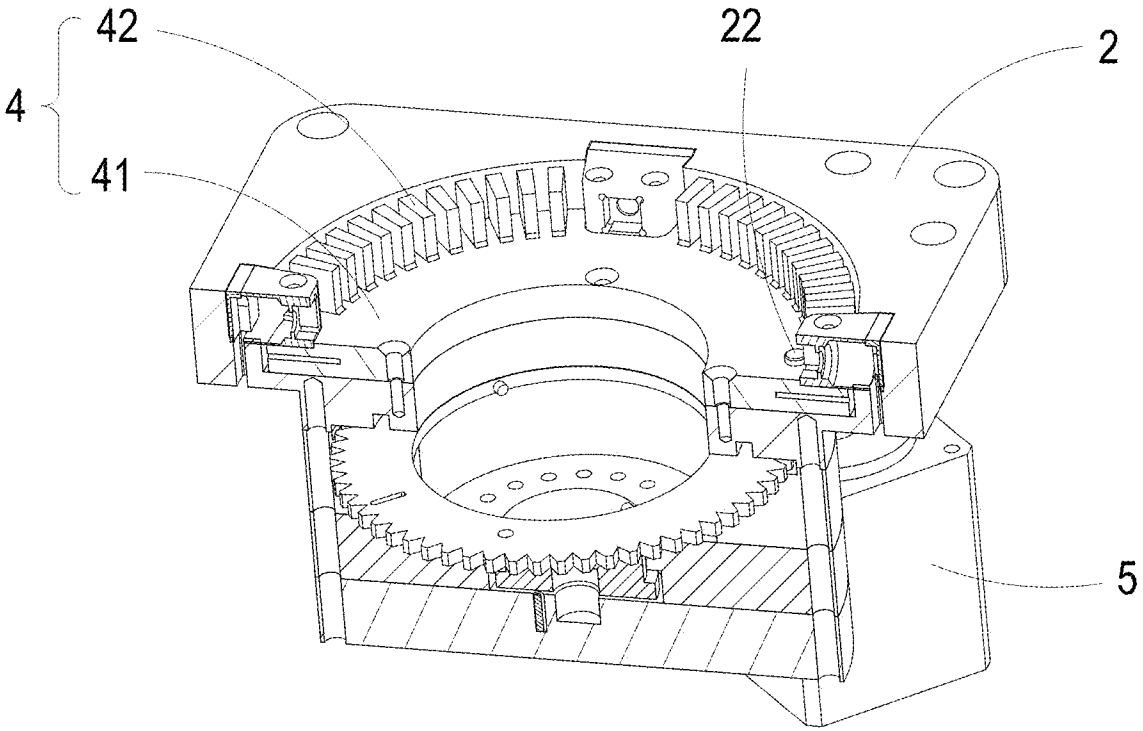
FIG. 5 shows partial internal structures of the nucleic acid analysis apparatus.

In an embodiment, the reaction chip 72 further includes at least one alignment slot 723, and the main frame 2 further includes at least one positioning component 22 (as shown in FIG. 5). For example, the positioning component 22 includes a positioning pin. When the cartridge 7 is placed into the chamber 21 of the main frame 2, the alignment slot 723 of the cartridge 7 is aligned with the positioning component 22 of the main frame 2, which helps an easy cartridge loading, and accordingly, the cartridge 7 may be self-aligned with the fluid delivery unit 3, and each optical unit 6 is in line with one of the detection wells 721. In an embodiment, each of the detection wells 721 has at least one planar surface. For example, the detection well 721 may be rectangular-shaped and have one planar surface in line with an optical detector of the optical unit 6 during nucleic acid detection.

The cartridge body 71 includes plural chambers 711 used to store reagents for sample purification and/or nucleic acid extraction. The cartridge body 71 also includes plural channels connected with the chambers 711 for fluid delivery. In an embodiment, the cartridge body 71 is but not limited to a cylindrical body. The cartridge body 71 further includes plural openings 712 at the bottom surface of the cartridge body 71, and the openings 712 are communicated with the chambers 711 through the channels. The shape of the openings 712 may be but not limited to circular, linear or other regular or irregular shape.

The reaction chip 72 further includes at least one sample loading hole 724 at the top surface of the reaction chip 72, and the sample loading hole 724 aligns and communicates with at least one chamber 711 of the cartridge body 71 for adding sample into the cartridge 7.

During the operation, once the sample is loaded, the sample loading hole 724 is sealed and the cartridge 7 is placed into the chamber 21 of the nucleic acid analysis apparatus 10 and is forced to tightly contact the fluid delivery unit 3 without leakage, and then the flow processing is carried out by the fluid delivery unit 3. The fluid delivery unit 3 works concurrently with the cartridge 7 to carry out sample purification, nucleic acid extraction and fluid delivery so as to have a fully automatic device. The fluid delivery could be realized by pneumatic, vacuum, plunger, chamber deformation, thermal-induced expansion, acoustics, centrifugal force or other methods as long as the sample processing is completed within the cartridge body 71.

In an embodiment, the flow is driven pneumatically through microchannels and holes. For example, the fluid delivery unit 3 is similar to the integrated fluidic module of U.S. Pat. No. 10,124,335 B2 filed by the applicant of the present invention, the entire contents of which are incorporated herein by reference and are not redundantly described here. In brief, the fluid delivery unit 3 of the present invention includes the fluid manifold, the valve stator, the valve rotor, the valve housing and the fluid sources as disclosed in U.S. Pat. No. 10,124,335 B2. The fluid manifold includes plural microchannels for connecting with the chambers 711 of the cartridge 7 through the bottom openings 712. By the alignments of the through holes and/or grooves of the valve stator and the valve rotor, multi-way fluid path switching is realized when the valve rotor is rotated to different positions, so as to regulate the fluid operations in the cartridge 7. Thereby, the reagents stored within the cartridge 7 are able to be transported to desired locations through pneumatic force from pumps of the fluid delivery unit 3, so as to automatically perform the sample purification and the nucleic acid extraction. Certainly, the fluid delivery unit 3 is not limited to the above-mentioned design, and can be any other type as long as it is able to realize multiple fluid delivery and multi-way fluid path switching in the cartridge 7.

Figure 6:
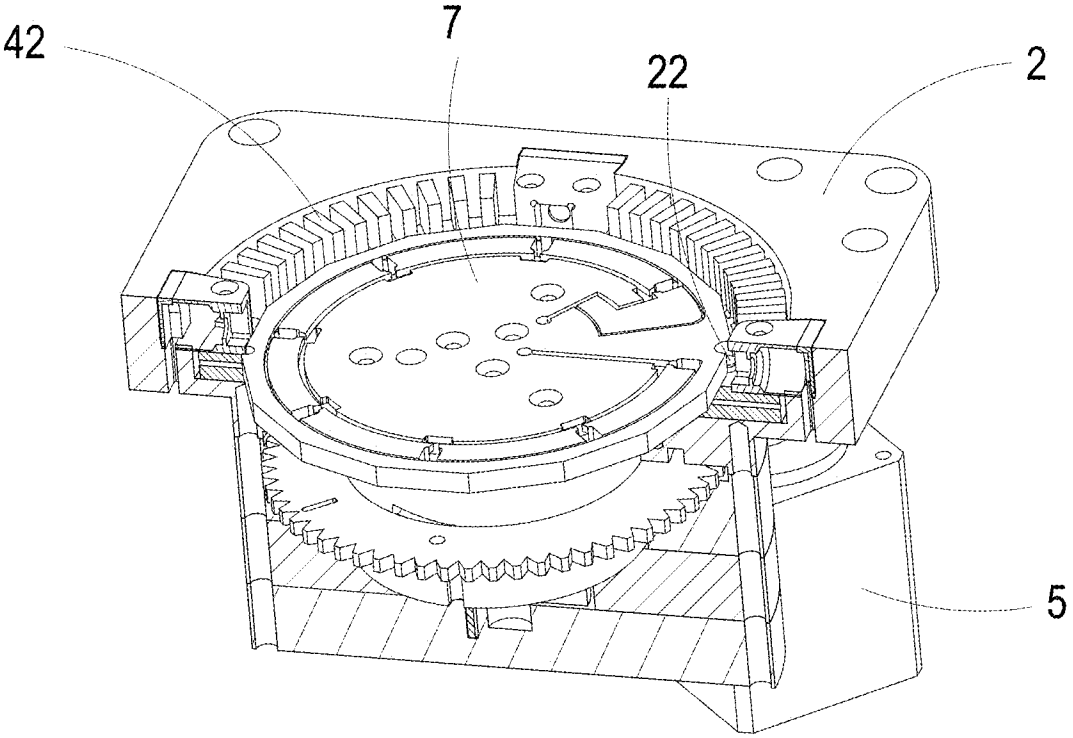
FIG. 6 shows the structures of FIG. 5 and the cartridge mounted thereon.

FIG. 5 shows partial internal structures of the nucleic acid analysis apparatus, and FIG. 6 shows the structures of FIG. 5 and the cartridge mounted thereon. As shown in FIGS. 5 and 6, the thermal unit 4 is disposed on the main frame 2 and includes a heater 41 and a heat spreader 42. In an embodiment, the heater 41 is a metal heating element with temperature control algorism, and the heat spreader 42 includes plural heat sinks mounted on the heater 41 and arranged as a circle to facilitate heat spreading. The heater 41 has a central hole with a diameter slightly greater than that of the cartridge body 71 so that the cartridge 7 could be easily mounted. When the cartridge 7 is mounted into the chamber 21, the thermal unit 4 carries the reaction chip 72 thereon, and the reaction chip 72 is in contact with the heater 41 and surrounded by the heat spreader 42. Since the reaction chip 72 is in direct contact with the thermal unit 4 and could be heated by contact heating, the nucleic acid analysis apparatus 10 of the present invention has superior heating efficiency and reduced heating time.

In an embodiment, the nucleic acid analysis apparatus 10 is designed to amplify nucleic acid based on isothermal method and therefore only a constant temperature instead of thermal cycling among three different temperature zones is needed. As a result, the thermal unit 4 is significantly simplified. In addition, the chamber 21 of the nucleic acid analysis apparatus 10 is designed with superior thermal insulation and therefore the inner temperature is easily maintained. Once the chamber 21 is in a uniform temperature environment, heat loss from the detection wells 721 and sample towards the environment could be minimized. At the amplification and/or detection processes, the whole closed chamber 21 and the sample at each detection well 721 are substantially in the same temperature, regardless the cartridge 7 is in motion or in stationary.

The thermal unit 4 provides the required temperature within the chamber 21 during the operation, wherein the temperature control is independent of the number and shape of detection wells 721. In an embodiment, the thermal unit 4 further includes a temperature sensor to control the accuracy of the temperature.

Figure 7:
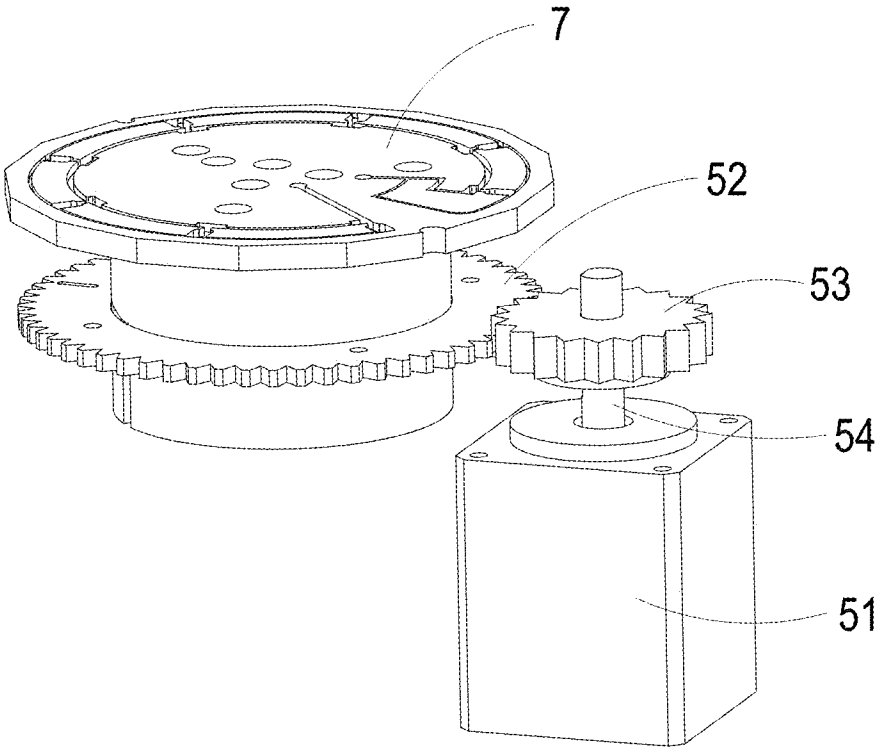
FIG. 7 shows the structural relationship between the driving unit and the cartridge.

FIG. 7 shows the structural relationship between the driving unit and the cartridge. The driving unit 5 includes but not limited to a motor, and it may also be solenoid, manual operation, spring, clockwork or other components, as long as it is able to clamp and rotate the cartridge 7 at predefined angles and speeds and convey each detection well 721 in alignment with each optical unit 6 sequentially. In an embodiment, the driving unit 5 includes a stepper motor 51, which is able to drive the rotation of the cartridge 7 in different patterns. The driving unit 5 further includes a motion control unit 52, which is adapted to clamp and rotate the cartridge 7 during nucleic acid amplification and detection, and also provide good sealing between the cartridge 7 and the fluid delivery unit 3 during sample purification and nucleic acid extraction. In an embodiment, the motion control unit 52 is an annular motion control unit, and the motion control unit 52 has a central hole with a diameter slightly greater than that of the cartridge body 71 so that the cartridge 7 could be easily mounted and rotated on demand.

The motion control unit 52 may be actuated by the stepper motor 51 through gear, belt, chain, rack, worm or other mechanical transmission mechanism. In an embodiment, the motion control unit 52 is a motion control gear, and the driving unit 5 further includes a driven gear 53 connected with the stepper motor 51 through a shaft 54. The motion control unit 52 is engaged with the driven gear 53, and the stepper motor 51 drives the rotations of the driven gear 53 and the motion control unit 52, and thus drives the movement and rotation of the cartridge 7 clamped by the motion control unit 52.

Figure 8B:
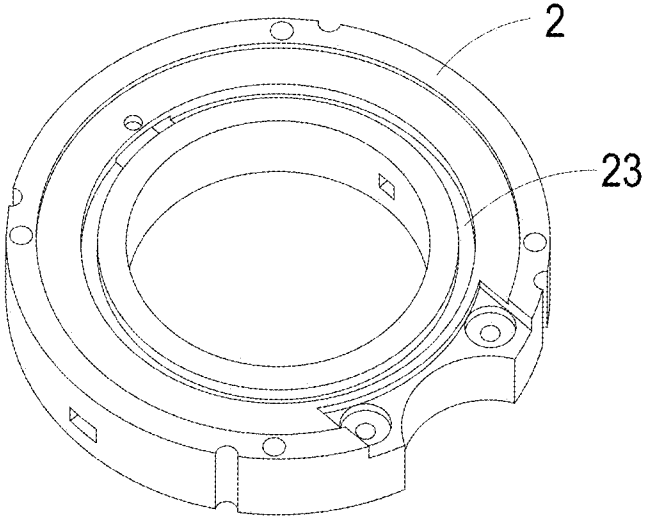
FIGS. 8A and 8B show the disposition of the motion control unit on the main frame.
Figure 8A:
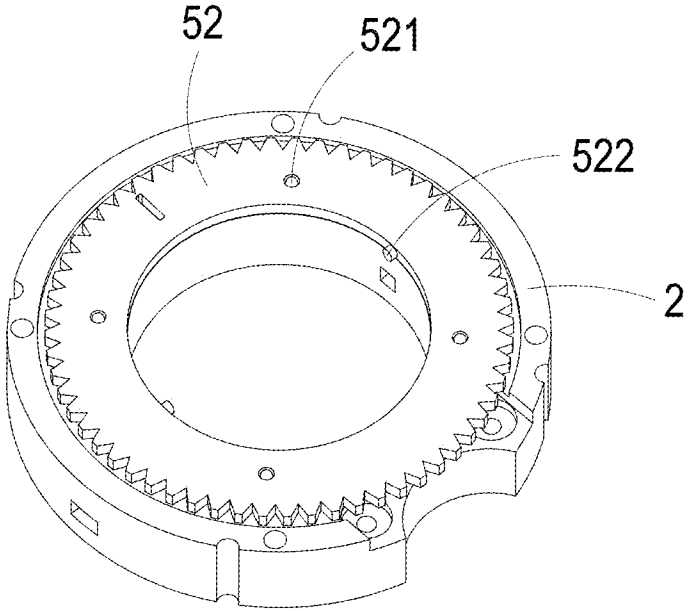

FIGS. 8A and 8B show the disposition of the motion control unit on the main frame. The motion control unit 52 includes a plurality of rollers 521 placed in corresponding round holes with a defined diameter. Accordingly, the main frame 2 has an annular groove 23 that can accommodate the rollers 521 of the motion control unit 52 and restrain the trajectory of the motion control unit 52. When the motion control unit 52 is in operation, the rollers 521 and the annular groove 23 on the main frame 2 allow the motion control unit 52 to concentrically rotate according to the central axis exactly. The rollers 521 of the motion control unit 52 also minimize the friction during the operation and eliminate the use of bearing or other lubrications. In an embodiment, two corresponding structures are designed to be formed on the motion control unit 52 and the cartridge 7, respectively, so as to control the movement of the cartridge 7. For example, the motion control unit 52 further includes at least one protrusion 522, such as dowel pin or other similar structure, so that the motion of the cartridge 7 can be managed by providing a corresponding groove-like structure on the cartridge body 71.

As shown in FIG. 3, the cartridge 7 includes at least one guiding groove 73 disposed on the outer surface of the cartridge body 71, and the guiding groove 73 can work with the protrusion 522 of the motion control unit 52 to control the motion of the cartridge 7. In an embodiment, the guiding groove 73 includes a vertical groove 731 and an inclined groove 732, wherein the vertical groove 731 extends vertically from the bottom of the cartridge 7, and the inclined groove 732 extends inclinedly and ascendingly from the top end of the vertical groove 731. At the beginning, the motion control unit 52 is in the starting position allowing the cartridge mounting. When the cartridge 7 is mounted by the user into the chamber 21, the vertical groove 731 matches the protrusion 522 of the motion control unit 52 so that the cartridge 7 can slide to the end position at which the bottom surface of the cartridge 7 connects with the fluid delivery unit 3. Subsequently, the stepper motor 51 actuates the motion control unit 52 and therefore the protrusion 522 of the motion control unit 52 rotates along the inclined groove 732 on the cartridge 7 and therefore presses and locks the cartridge 7.

In an embodiment, the motion control unit 52 includes two symmetric protrusions 522, and correspondingly, the cartridge 7 also includes two symmetric guiding grooves 73. Certainly, the numbers of the protrusions 522 and the guiding grooves 73 are not limited to two.

Figure 9B:
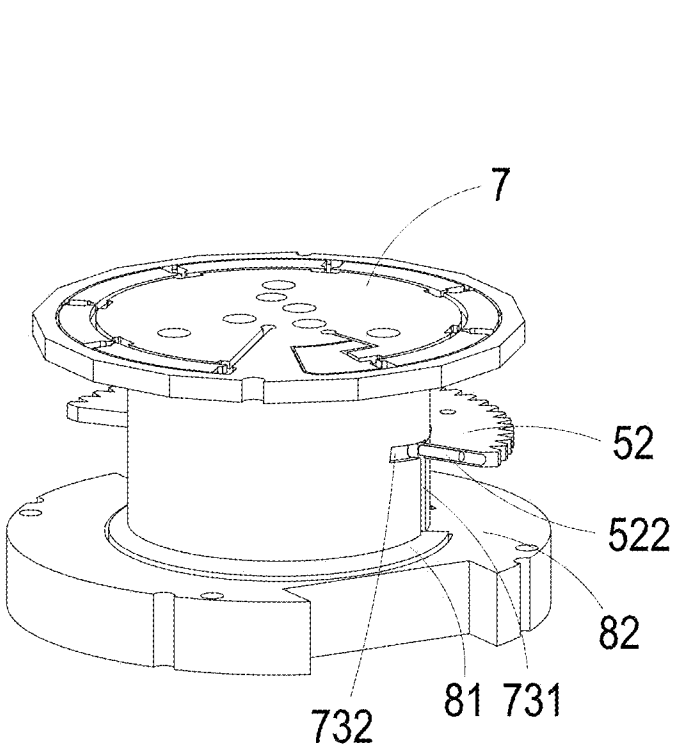
FIGS. 9A to 9F show the working procedure to complete the isothermal based all-in-one detection.
Figure 9A:
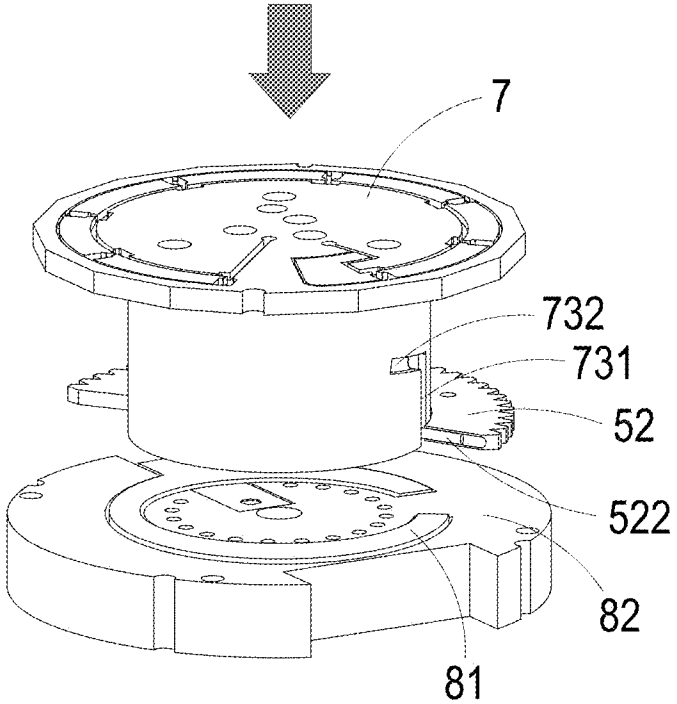

FIGS. 9A to 9F show the working procedure to complete the isothermal based all-in-one detection. In order to have a better illustration, only main components are illustrated and partial structure of the motion control unit is hidden. At the bottom of the chamber 21, a spring-supported component 81 is equipped on a fluid connector 82 located between the main frame 2 and the fluid delivery unit 3. First, the user adds a collected sample into the cartridge 7 and mounts the cartridge 7 into the chamber 21. At the meantime, the guiding groove 73 of the cartridge 7 is aligned with the protrusion 522 of the motion control unit 52 (as shown in FIG. 9A), and the protrusion 522 of the motion control unit 52 is able to move along the vertical groove 731, which allows the cartridge 7 to slide down to the end. Once the cartridge 7 is mounted, the user presses the cartridge 7 downwardly until it contacts the fluid connector 82 (as shown in FIG. 9B).

In an embodiment, a sensor is embedded at the bottom of the chamber 21 to recognize the position of the cartridge 7 and is able to feedback as long as the cartridge 7 is pressed to contact the fluid connector 82. At the moment, the protrusion 522 of the motion control unit 52 reaches the highest point of the vertical groove 731, i.e. the cartridge 7 is presses to the end and after which the motion control unit 52 is actuated to lock the cartridge 7, and an indicator, such as LED, is shining to inform the user to release his hand. By this design, the cartridge 7 is installed by user's hand, and thus the driven motor torque is minimized.

Figure 9D:
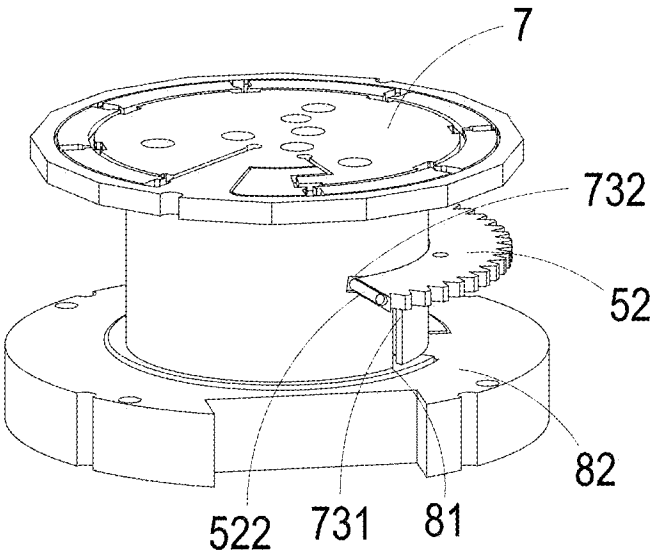
Figure 9C:
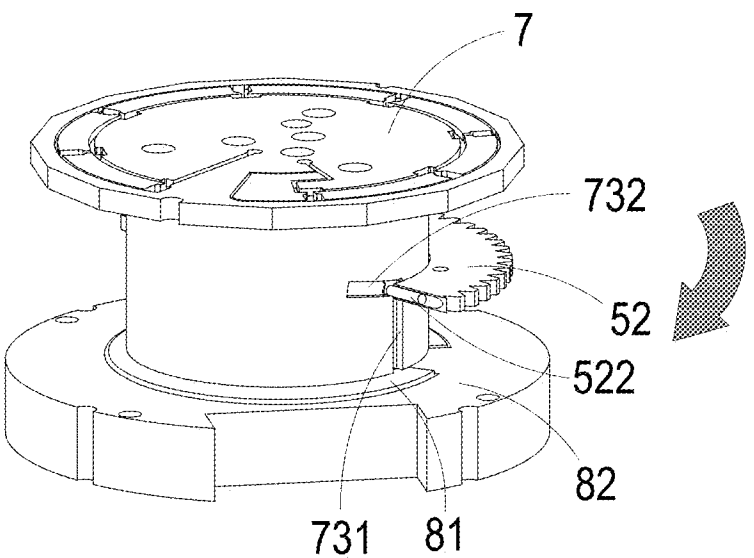

When the cartridge 7 is pressed down to the end, a signal is sent to the MCU, and then the stepper motor 51 is triggered so that the motion control unit 52 can rotate forwardly and the protrusion 522 can slide along the inclined groove 732 on the cartridge 7 (as shown in FIG. 9C). Accordingly, the cartridge 7 is further pressed down and the spring-supported component 81 is compressed (as shown in FIG. 9D). As a result, the cartridge 7 is locked by the motion control unit 52 and squeezed a bit to ensure a tight contact with the fluid connector 82. Subsequently, the sample preparation and the nucleic acid extraction will be carried out.

Figure 9F:
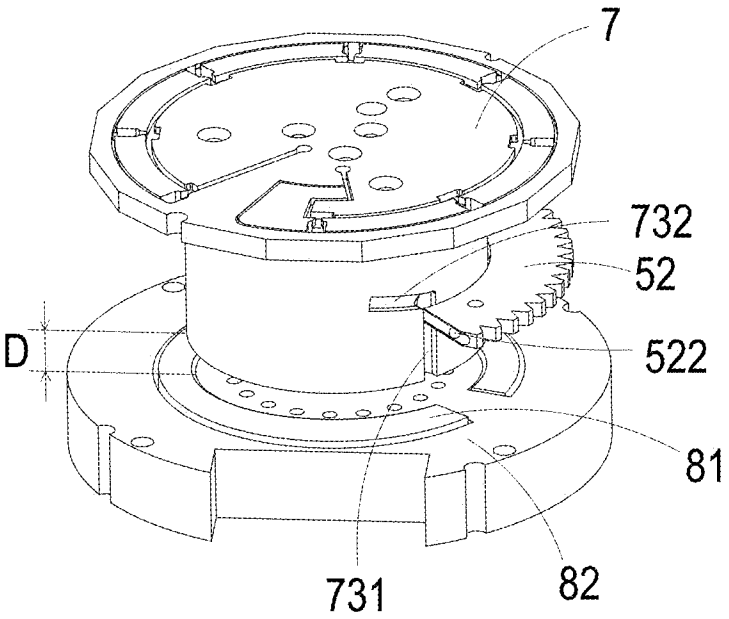
Figure 9E:
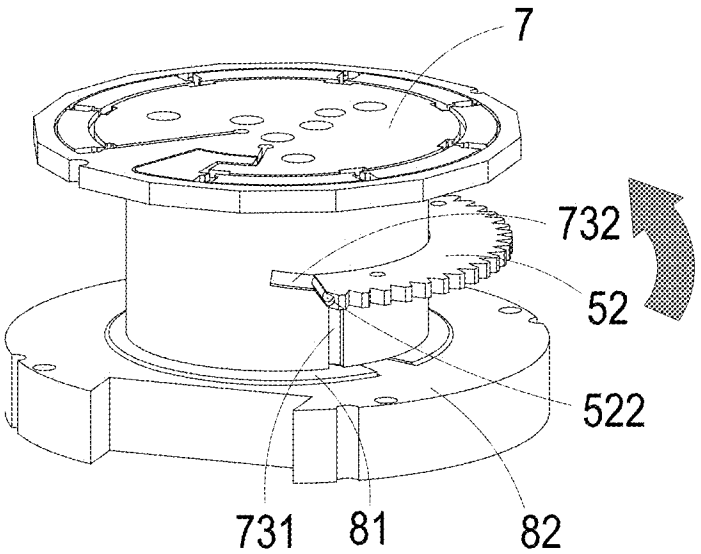

After the sample with extracted nucleic acid is dispensed to the detection wells 721 of the cartridge 7 and heated to a pre-defined temperature, the motion control unit 52 rotates reversely and the protrusion 522 moves backwardly along the inclined groove 732 (as shown in FIG. 9E) until arrives the vertical groove 731. When the protrusion 522 reaches the vertical groove 731, the cartridge 7 will be bounced up by the spring-supported component 81 and detach the fluid connector 82 with a short pre-defined distance D (as shown in FIG. 9F). In an embodiment, the distance D may be 0.5-5 mm, and preferably 0.5-3 mm. Thus, the friction between the interfaces is minimized and the reaction chip 72 of the cartridge 7 is lifted above the positioning component 22, so the cartridge 7 could be freely rotated within the chamber 21 during the nucleic acid amplification and detection.

At the nucleic acid amplification and detection stage, since the cartridge 7 is constrained by the protrusion 522 at this moment, the further reverse rotation of the motion control unit 52 will drive the rotation of the cartridge 7. Therefore, the cartridge 7 can be rotated with the predefined programs by the motion control unit 52 to align the detection wells 721 with each optical unit 6 sequentially for nucleic acid detection until the completion of the detection.

In an embodiment, the nucleic acid analysis apparatus 10 includes multiple optical units 6. The optical unit 6 has optical components such as light source, lens, filter and optical detector to realize the optical detection so that the sample could be detected in real time during the nucleic acid amplification. The optical unit 6 may include at least one light source 61 and at least one optical detector 62 (as shown in FIG. 1). In an embodiment, the light source 61 is but not limited to an LED, and the optical detector 62 is but not limited to a photodiode. During the operation, each light source 61 aligns with one of the detection wells 721 in order to offer effective illumination for detection, and each optical detector 62 aligns with one of the detection wells 721 and therefore the results of nucleic acid analysis are interpreted. The rotation of the cartridge 7 allows each detection well 721 to pass through different optical units 6 sequentially. In an embodiment, each optical unit 6 could offer a unique wavelength of illumination so as to provide different colors for fluorescent based detection, and thus, the nucleic acid analysis apparatus 10 can detect multiple targets simultaneously and realize multiplexing detection.

By utilizing the isothermal based amplification, the thermal unit 4 is significantly simplified, and thus, the nucleic acid analysis apparatus 10 can be compact designed and is even smaller than a common teacup. In an embodiment, the nucleic acid analysis apparatus 10 has a height ranged between 100 mm and 200 mm and a width ranged between 80 mm and 120 mm. Since the nucleic acid analysis apparatus 10 is cup sized, it is portable and suitable for POC diagnostics.

Figure 10:
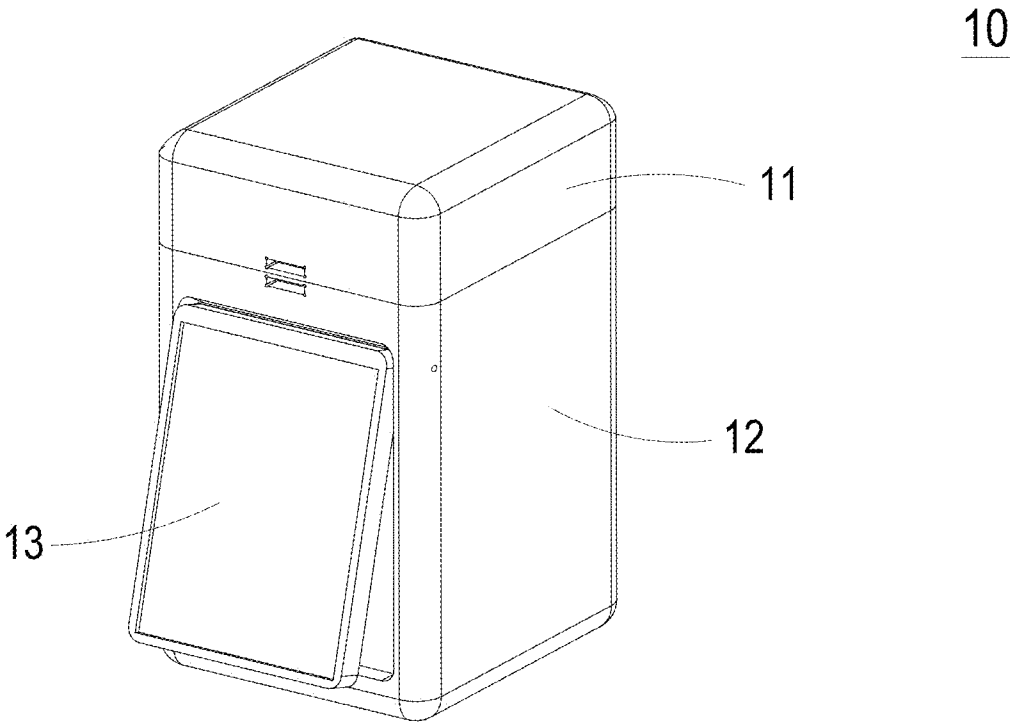
FIG. 10 shows another schematic view of the nucleic acid analysis apparatus.

Further, by rearranging the driving unit 5 and the motion control unit 52 to the lower casing 12, both size and weight of the top part of the nucleic acid analysis apparatus 10 are reduced. FIG. 10 shows another schematic view of the nucleic acid analysis apparatus. As shown in FIGS. 1 and 10, the nucleic acid analysis apparatus 10 further includes a touch screen 13 disposed on the lower casing 12 for user operation and results showing. Since the lower casing 12 is enlarged, the size of the touch screen 13 could also be enlarged. Compared to the conventional top-mounted touch screen, the touch screen 13 on the nucleic acid analysis apparatus 10 of the present invention could be increased to larger sizes. In addition, the touch screen 13 is designed to have adjustable operation angles to facilitate user's viewing and operation.

In an embodiment, the nucleic acid analysis apparatus 10 is designed for isothermal based amplification, and thus can be used to perform all isothermal amplification methods, such as nucleic acid sequence-based amplification (NASBA), strand displacement amplification (SDA), helicase-dependent amplification (HDA), loop-mediated isothermal amplification (LAMP), recombinase polymerase amplification (RPA) and nicking enzyme amplification reaction (NEAR).

In another embodiment, the nucleic acid analysis apparatus 10 may also be designed for PCR-based amplification. For example, the spring-supported component 81 may be equipped with a heater therein to provide another temperature zone.

In conclusion, the present invention provides an all-in-one nucleic acid analysis apparatus, which integrates the fluid delivery unit, the thermal unit, the driving unit and the optical unit on one single device, so that the processes of sample purification, nucleic acid extraction, nucleic acid amplification and nucleic acid detection can be performed on the all-in-one apparatus to realize nucleic acid analysis in real time. Therefore, the nucleic acid analysis apparatus provides an easy and fast nucleic acid analysis. In addition, since the thermal unit is significantly simplified, the nucleic acid analysis apparatus can be compact designed, so it is portable and suitable for POC diagnostics. Moreover, since the cartridge is pressed down by user's hand, the nucleic acid analysis apparatus has reduced motor size for motion control unit. Besides, by rearranging the driving unit and the motion control unit to the lower casing, both size and weight of the top part of the nucleic acid analysis apparatus are reduced. Further, the touch screen disposed on the lower casing could be enlarged and could have adjustable operation angles to facilitate user's viewing and operation.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A nucleic acid analysis apparatus, comprising:

a casing having an upper casing and a lower casing;

a main frame disposed in the lower casing and having a chamber for mounting a cartridge therein;

a fluid delivery unit disposed in the lower casing and connected with the main frame, being adapted to transport reagents within the cartridge for sample purification and/or nucleic acid extraction, wherein the fluid delivery unit comprises a plurality of microchannels for connecting with the cartridge and a pump adapted to provide pneumatic force to transport the reagents stored within the cartridge;

a thermal unit disposed on the main frame of the lower casing and comprising a heater to provide a predefined temperature for nucleic acid amplification;

a driving unit disposed in the lower casing and connected with the main frame, the driving unit comprising a motor, a shaft, a driven gear, and a motion control gear, wherein the motion control gear is engaged with the driven gear mounted on the shaft, and the motor drives rotations of the driven gear and the motion control gear, and thus drives movement and rotation of the cartridge clamped by the motion control gear, wherein the motion control gear comprises at least one protrusion, the cartridge comprises at least one guiding groove having a vertical groove and an inclined groove, and the protrusion is able to slide in the guiding groove, so that the motion control gear is capable of pressing the cartridge toward the fluid delivery unit during sample purification and/or nucleic acid extraction and rotating the cartridge during nucleic acid amplification and/or detection; and at least one optical unit disposed on the main frame of the lower casing and comprising at least one light source and at least one optical detector for detection.

2. The nucleic acid analysis apparatus according to claim 1, wherein the motor comprises a stepper motor, which actuates a rotation of the motion control gear through gear transmission.

3. The nucleic acid analysis apparatus according to claim 2, wherein the motion control gear comprises a plurality of rollers, which are accommodated in an annular groove of the main frame.

4. The nucleic acid analysis apparatus according to claim 1, wherein the nucleic acid analysis apparatus further comprises a fluid connector located between the main frame and the fluid delivery unit, and a flat spring equipped on the fluid connector.

5. The nucleic acid analysis apparatus according to claim 4, wherein a forward rotation of the motion control gear allows the cartridge to be locked and in contact with the fluid connector.

6. The nucleic acid analysis apparatus according to claim 5, wherein a reverse rotation of the motion control gear allows the cartridge to be bounced up by the flat spring, detach the fluid connector, and rotate according to the predefined program.

7. The nucleic acid analysis apparatus according to claim 1, wherein the nucleic acid analysis apparatus further comprises a sensor to recognize a position of the cartridge.

8. The nucleic acid analysis apparatus according to claim 1, wherein the nucleic acid analysis apparatus further comprises an indicator, which is shining when the cartridge is pressed to the end to inform a user to release his hand.

9. The nucleic acid analysis apparatus according to claim 1, wherein the optical unit comprises a light source and an optical detector.

10. The nucleic acid analysis apparatus according to claim 1, wherein the nucleic acid analysis apparatus comprises multiple optical units, and each optical unit offers a unique wavelength of illumination to detect multiple targets.

11. The nucleic acid analysis apparatus according to claim 1, wherein the nucleic acid analysis apparatus further comprises a touch screen disposed on the lower casing with adjustable operation angles.

12. The nucleic acid analysis apparatus according to claim 1, wherein the cartridge comprises a reaction chip and a cartridge body, and the reaction chip is disposed on one side of the cartridge body.

13. The nucleic acid analysis apparatus according to claim 12, wherein the main frame further comprises at least one positioning pin, and the reaction chip comprises at least one alignment slot capable of being aligned with the at least one positioning pin on the main frame.

14. The nucleic acid analysis apparatus according to claim 12, wherein the cartridge body comprises plural chambers used to store reagents for sample purification and nucleic acid extraction.

15. The nucleic acid analysis apparatus according to claim 12, wherein the reaction chip further comprises at least one sample loading hole at a top surface of the reaction chip for adding sample into the cartridge.

16. The nucleic acid analysis apparatus according to claim 12, wherein the thermal unit carries the reaction chip thereon to provide heating.

17. The nucleic acid analysis apparatus according to claim 12, wherein the reaction chip is a planar fluidic chip and comprises a plurality of detection wells and at least one microchannel connected with the detection wells.

18. The nucleic acid analysis apparatus according to claim 17, wherein the shape of the reaction chip is substantially a regular polygon, and each of the detection wells has at least one planar surface.

* * * * *